US009371121B1

(12) United States Patent
Jenkins et al.

(10) Patent No.: US 9,371,121 B1
(45) Date of Patent: Jun. 21, 2016

(54) HIGH-TAILED WING SAIL

(71) Applicant: Photon Composites, Inc., Alameda, CA (US)

(72) Inventors: Richard Elliott Jenkins, Alameda, CA (US); George Seyfang, Preston (GB)

(73) Assignee: PHOTON COMPOSITES, INC., Alameda, CA (US)

( * ) Notice: Subject to any disclaimer, the term of this patent is extended or adjusted under 35 U.S.C. 154(b) by 0 days.

(21) Appl. No.: 14/579,513

(22) Filed: Dec. 22, 2014

(51) Int. Cl.
*B63H 9/04* (2006.01)
*B63H 9/06* (2006.01)
*B63H 9/08* (2006.01)

(52) U.S. Cl.
CPC ..... *B63H 9/0657* (2013.01); *B63H 9/08* (2013.01)

(58) Field of Classification Search
CPC ..... B63H 9/08; B63H 9/0657
USPC ..... 114/102.1
See application file for complete search history.

(56) References Cited

U.S. PATENT DOCUMENTS 6,925,949 B1 * 8/2005 Phillips ..... B63H 9/0685 114/102.1

* cited by examiner

*Primary Examiner* — Stephen Avila
(74) *Attorney, Agent, or Firm* — Hickman Palermo Becker Bingham LLP

(57) ABSTRACT

A high-tailed wing sail is provided. A wing sail device includes a wing body including a wing tip and a wing base configured to rotationally couple with a vessel. The wing body is configured to freely rotate with respect to the vessel about a rotational axis. The wing sail device further includes a wing tail coupled to the wing body such that a top end of the wing tail is higher than the wing tip of the wing body.

20 Claims, 7 Drawing Sheets

HIGH-TAILED WING SAIL

FIELD OF THE INVENTION

Embodiments of the invention described herein relate generally to aerodynamics, and, more specifically, to wing sail devices.

BACKGROUND

Transportation by water is an important aspect of modern commerce. Water-based transportation has been the largest carrier of freight throughout recorded history. Large vessels such as tankers and freight vessels are especially valuable since efficiency and seaworthiness increase with the size of the vessel. Water-based vessels are also used for passenger travel, such as passenger and car ferries, as well as cruises and other leisure travel.

Water-based vessels must carry, generate or otherwise harness all the power they consume during a trip away from land. Carbon-based liquid fuel is the principal power source for commercial water transportation. A single passenger ferry may burn million dollars of fuel each year. Although alternative power sources have been explored, the shipping industry is reliant on fuel. The environmental effect of burning fuel and the price of the fuel itself are substantial. Partially wind-powered cargo vessels have been proposed for reducing fuel consumption by fuel-burning vessels.

Rigid wing sails are an alternative to traditional fabric sails. A rigid wing sail acts as an airfoil to create lift in the desired direction. Although more efficient than a traditional fabric sail, a rigid wing sail typically adds more weight to a vessel. It is desirable to increase the efficiency of a rigid wing sail.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

General Overview

A wing sail device is described herein. The wing sail device includes one or more high-tailed wing sails. The high-tailed wing sail includes a wing body coupled with a wing tail that is positioned to harness additional power from a tip vortex generated at the tip of the wing body. The tip vortex is generated due to a pressure differential on wing body when the high-tailed wing sail is in operation. When air flows around the wing body, air pressure is higher on one side than the other side. At the tip of the wing body, the tip vortex forms when the higher pressure airflow meets the lower pressure airflow, resulting in a directional vortex from the higher pressure side to the lower pressure side. By placing the tail in the tip vortex, additional energy is harnessed.

High-Tailed Wing Sail

Figure 1:
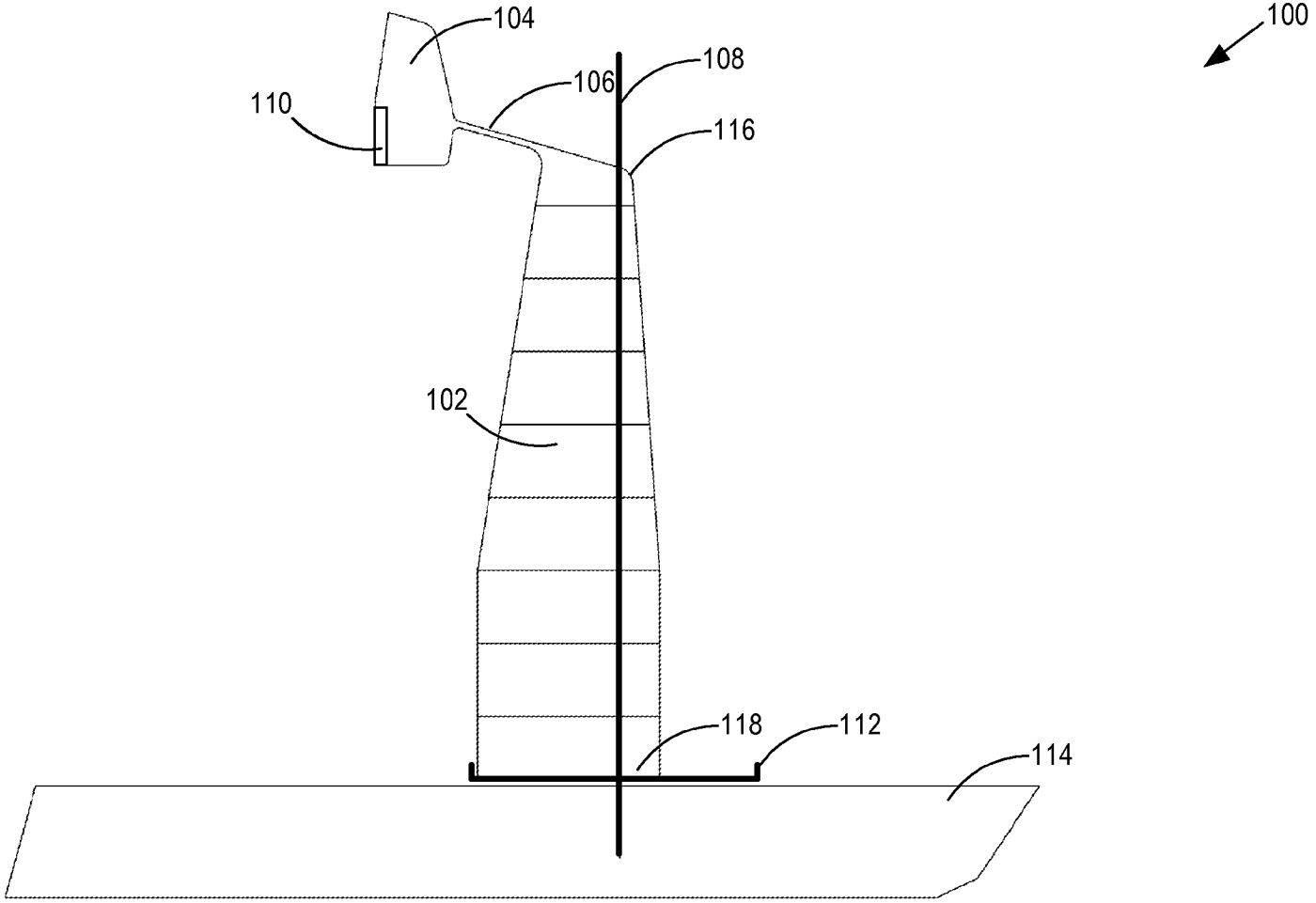
FIG. 1 illustrates an embodiment of a high-tailed wing sail.

FIG. 1 illustrates an embodiment of a high-tailed wing sail. High-tailed wing sail 100 includes wing body 102. When air flows over wing body 102, wing body 102 generates lift that is usable to propel vessel 114. A first end of wing body 102 is referred to as wing tip 116, and a second end of wing body 102 is referred to as wing base 118. Wing body 102 is configured to rotationally couple with and freely rotate with respect to vessel 114. In one embodiment, wing body 102 is configured to removably couple with vessel 114, such as to facilitate transportation, repair, storage, or any other function.

High-tailed wing sail 100 further includes wing tail 104. Coupling arm 106 connects wing tail 104 and wing body 102. Coupling arm 106 allows the positioning of wing tail 104 away from wing body 102. Alternatively, wing tail 104 may be directly coupled with wing body 102 without coupling arm 106. Wing tail 104 controls the angle of wing body 102 relative to the direction of air flow of the wind, or the angle of attack. Typically, in a wing sail, the tail is positioned behind the wing. In operation, the air flow interacts with the wing tail to generate a stabilizing force that keeps the wing body at a desired angle, which shall be described in greater detail hereafter.

Wing tail 104 is positioned to harness additional power from tip vortex generated at wing tip 116. The tip vortex is generated due to a pressure differential on wing body 102 when high-tailed wing sail 100 is in operation. The positioning of wing tail 104 is described in greater detail hereafter.

Wing body 102, wing tail 104 and coupling arm 106 are constructed from one or more substantially rigid components, such as substantially rigid plastics, wood, composite materials, metals, or any other substantially rigid component. Wing body and/or wing tail 104 may be constructed from one or more substantially rigid components forming a frame over which a skin material is disposed. In this case, the skin material may be a flexible, rigid, or a substantially rigid material.

In one embodiment, wing body 102, wing tail 104 and coupling arm 106 are coupled in a fixed manner. For example, one or more mechanical fastening devices may be used to couple wing tail 104 to coupling arm 106 and/or wing body 102 to coupling arm 106, such as screws, nuts, bolts, nails, clamps, rivets, dowels, clips, washers, latches, ties, staples, pins, or any other mechanical fastening device or combination thereof. Alternatively and/or in addition, one or more adhesives may be used to couple wing tail 104 to coupling arm 106 and/or wing body 100 to coupling arm 106, such as glue, tape, resins, epoxies, cements, or any other adhesive or combination thereof. In one embodiment, wing body 102, wing tail 104 and/or coupling arm 106 may be formed as a single piece in a manufacturing process, such as a composite fabrication process, a molding process, or any other manufacturing process.

In one embodiment, coupling arm 106 includes one or more mechanically moving components and is configured to movably couple wing tail 104 with wing body 102 such that the position of the wing tail 104 relative to wing body 102 is adjustable, which shall be described in greater detail hereafter.

Wing body 102 is configured to rotationally couple with vessel 114 at wing base 118. Wing body 102 is configured to freely rotate with respect to vessel 114 about rotational axis 108. Rotational axis 108 may be selected to statically balance high-tailed wing sail 100 with respect to rotational axis 108, including wing body 102 and any component coupled therewith (e.g. any counterweight, wing tail 104, control surface element 110, boom, sensor/s, communication device/s, power source, wiring, or any other component coupled with wing body 102). In one embodiment, the mass of high-tailed wing sail 100 is dynamically balanced with respect to rotational axis 108. In one embodiment, the location of rotational axis 108 is based on an aerodynamic center and/or a surface area of one or more wing components, and high-tailed wing sail 100 is weighted with one or more counterweights, for mass balance.

In one embodiment, high-tailed wing sail 100 further includes shield 112. Shield 112 provides a boundary within which hightailed wing sail 100 is free to rotate with respect to vessel 114. Shield 112 serves to provide a visual indicator and a physical barrier for the safety of passengers, crew and/or objects that may be in a rotational path of any rotating portion of hightailed wing sail 100 with respect to rotational axis 108. Shield 112 also acts to seal wing body 102 at wing base 118 from air flow passing under it, further increasing wing efficiency.

High-tailed wing sail 100 may further include one or more control systems and/or sensors configured to automate the operation of one or more wing sail devices. Such control systems and sensors shall be described in greater detail hereafter.

Control Surface Element

In one embodiment, high-tailed wing sail 100 further includes control surface element 110. Control surface element 110 is disposed on a trailing edge of high-tailed wing sail 100. As shown in FIG. 1, control surface element 110 may be disposed on a trailing edge of wing tail 104. Alternatively, control service element 110 may be disposed on a trailing edge of wing body 102. In one embodiment, high-tailed wing sail 100 includes more than one control surface element 110.

Control surface element 110 is configured to aerodynamically control a wing angle of wing body 102 based on a force exerted by an air flow interacting with control surface element 110. In one embodiment, the position of control surface element controls a wing angle of wing body 102 with respect to the air flow. More specifically, in a particular position, control surface element 110 reacts to the air flow to control the wing angle of freely rotating wing body 102, thereby controlling the amount of lift produced.

In one embodiment, control surface element 110 may be positioned in three distinct positions: a first maximum angle, a second maximum angle, and a neutral angle. When the control surface element position is set to the first maximum angle, control surface element 110 positions wing body 102 at a first wing angle relative to the air flow that creates lift in a first lift direction perpendicular to the direction of the air flow. When the control surface element position is set to the second maximum angle, control surface element 110 positions wing body 102 at a second wing angle relative to the air flow that creates lift in a second lift direction perpendicular to the direction of the land that is opposite to the first lift direction. The first maximum angle and the second maximum angle may be selected to maximize lift.

Although not identical to traditional sailing, changing the control surface element position between the first maximum angle and the second maximum angle is at least partially analogous to tacking and jibing. No lift may be desired in certain circumstances, such as when excessive wind is encountered or when substantially no motion is desired. When the control surface element position is set to the neutral angle, substantially no lift is created. The neutral angle is equivalent to an off position. When the control surface element is set in the off position, high-tailed wing sail 100 freely rotates to a position that minimizes drag.

As the control surface element position is moved from the neutral angle to the first maximum angle, the lift generated in the first lift direction is increased. Likewise, as the control surface element position is moved from the neutral angle to the second maximum angle, the lift generated in the second lift direction is increased. In one embodiment, three positions are provided for the control surface element: the first maximum angle, the second maximum angle, and the neutral angle (i.e. the off position). Alternatively, the control surface element may be configured to be positioned at additional angles, such as any angle between the first maximum angle and the second maximum angle. In one embodiment, a controller is configured to determine a control surface element position, which shall be described in greater detail hereafter.

Wing Tail Positioning

In one embodiment, wing tail 104 is coupled to wing body 102 such that wing tail 104 is positioned in an upper half of the tip vortex generated at wing tip 116 by a pressure differential on wing body 102. For example, wing tail 104 may be positioned in upper half of the tip vortex. In one embodiment, wing tail 104 may be coupled to wing body 102 such that a top end of wing tail 104 is higher than wing tip 116 of wing body 102. The placement of wing tail 102 to take advantage of the tip vortex can reduce the necessary area of wing tail 102 and/or the distance of wing tail 102 from wing body 104.

Figure 2:
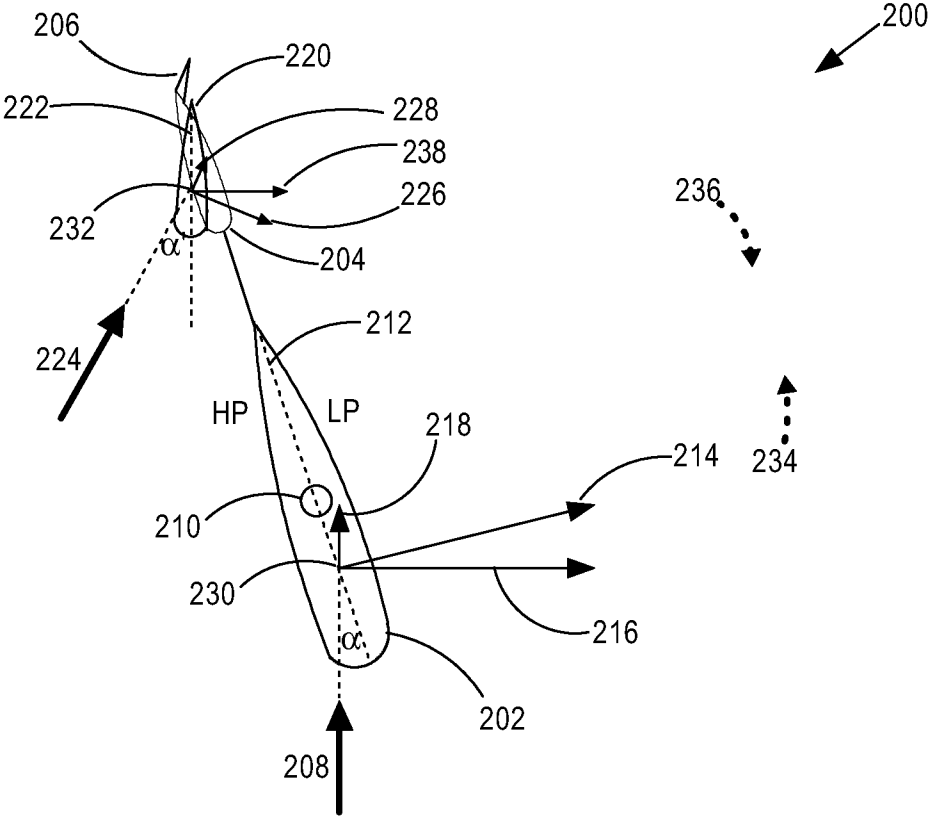
FIG. 2 is a free-body diagram of a top view of an embodiment of a high-tailed wing sail.

FIG. 2 is a free-body diagram of a top view of an embodiment of a high-tailed wing sail. High-tailed wing sail 200 includes wing body 202 and wing tail 204. High-tailed wing sail 200 is shown in a hypothetical operational state where high-tailed wing sail 200 is exposed to air flow 208, shown as a vector. Wing body 202 freely rotates about rotational axis 210. When exposed to air flow 208, wing body 202 generates torque 234 about rotational axis 210. Without being counterbalanced, torque 234 would cause wing body 202 to spin about rotational axis 210. This torque 234 is balanced out by torque 236 about rotational axis 210 generated by wing tail 204, resulting in the operational state illustrated in FIG. 2, which is stable for a constant air flow 208 given a constant position for control surface element 206.

The lift generated by an air foil, such as wing body 202 and wing tail 204, is proportional to the angle of attack of the air flow. The angle of attack of air flow 208 on wing body 202 is $\alpha$. The angle of attack $\alpha$ is shown with respect to center line 212 of wing body 202. When exposed to air flow 208, air travels around wing body 202 in two streams, forming a high pressure side HP and a low pressure side LP. The net force 214 generated by this process is shown with respect to a center of lift 230 of wing body 202. This net force 214 can be broken down into a drag component 218 and a lift component 216 with respect to a direction of air flow 208. The position of the center of lift 230, which is in front of rotational axis 210 with respect to air flow 208, causes torque 234 in a counter-clockwise direction. For high-tailed wing sail 200 to maintain a stable position with respect to rotational axis 210, torque 234 must be balanced out by a counteracting force, such as torque 236.

Torque 236 is generated by wing tail 204. As shown, wing tail 204 has control surface element 206. In one embodiment, an angle of wing tail 204 is fixed, but control surface element 206 may be positioned in a plurality of positions. According to principles of aerodynamics, the angle of control surface element 206 on an airfoil such as wing tail 204 may be approximated by an effective wing tail 220 at a different angle. Specifically, the angle of effective wing tail 220 is approximately proportional to the angle of control surface element 206. Thus, effective wing tail 220 is used to show the interactions. However, other configurations, such as a wing tail that may be positioned in different angles, may be implemented in accordance with the embodiments described herein.

Effective air flow 224 is a combination of air flow 208 and the force generated by a tip vortex coming off wing body 202. The angle of attack of effective air flow 224 on effective wing tail 220 is $\alpha'$. The angle of attack $\alpha'$ is shown with respect to center line 222 of effective wing tail 220. Because of the tip vortex's contribution to the effective air flow 224, the angle of attack $\alpha'$ is increased.

The net force 238 generated by the combination of air flow 208 and the tip vortex is shown with respect to a center of lift 232 of effective wing tail 220. This net force 238 can be broken down into a drag component 228 and a lift component 226 with respect to a direction of effective air flow 224. The position of the center of lift 232, which is behind rotational axis 210 with respect to air flow, causes torque 236 in a clockwise direction, thereby counteracting torque 234.

As noted above, lift is proportional to the angle of attack $\alpha'$. Therefore, when the tip vortex is utilized by wing tail 204 and the angle of attack $\alpha'$ is increased, the efficiency of wing tail 204 is raised. Lift is also proportional to surface area of an airfoil. Thus, when the tip vortex is utilized, a smaller wing tail 204 can be used generate the required amount of torque 236 to position wing body 202. Alternatively and/or in addition, wing tail 204 may be positioned closer to wing body 208, since the same torque 236 may be achieved with a smaller lever distance due to an increase in efficiency. Thus, when the tip vortex is utilized, a smaller wing tail 204 and/or a closer wing tail 204 can be used generate the required amount of torque 236 to position wing body 202.

A smaller and/or closer wing tail 204 allows for increased safety and lowered space requirements. For example, a shorter tail may be positioned within the bounds of a vessel, eliminating dangers when navigating around man-made structures, such as ports, docks, canals, and the like. The reduction in danger may eliminate the need to fold or otherwise put away one or more components of high-tailed wing sail 200. Furthermore, when achieving static and/or dynamic balancing, a smaller and/or closer wing tail 204 reduces the size, weight and/or distance of any counterbalancing components that are required.

Large-Vessel Application

Figure 3:
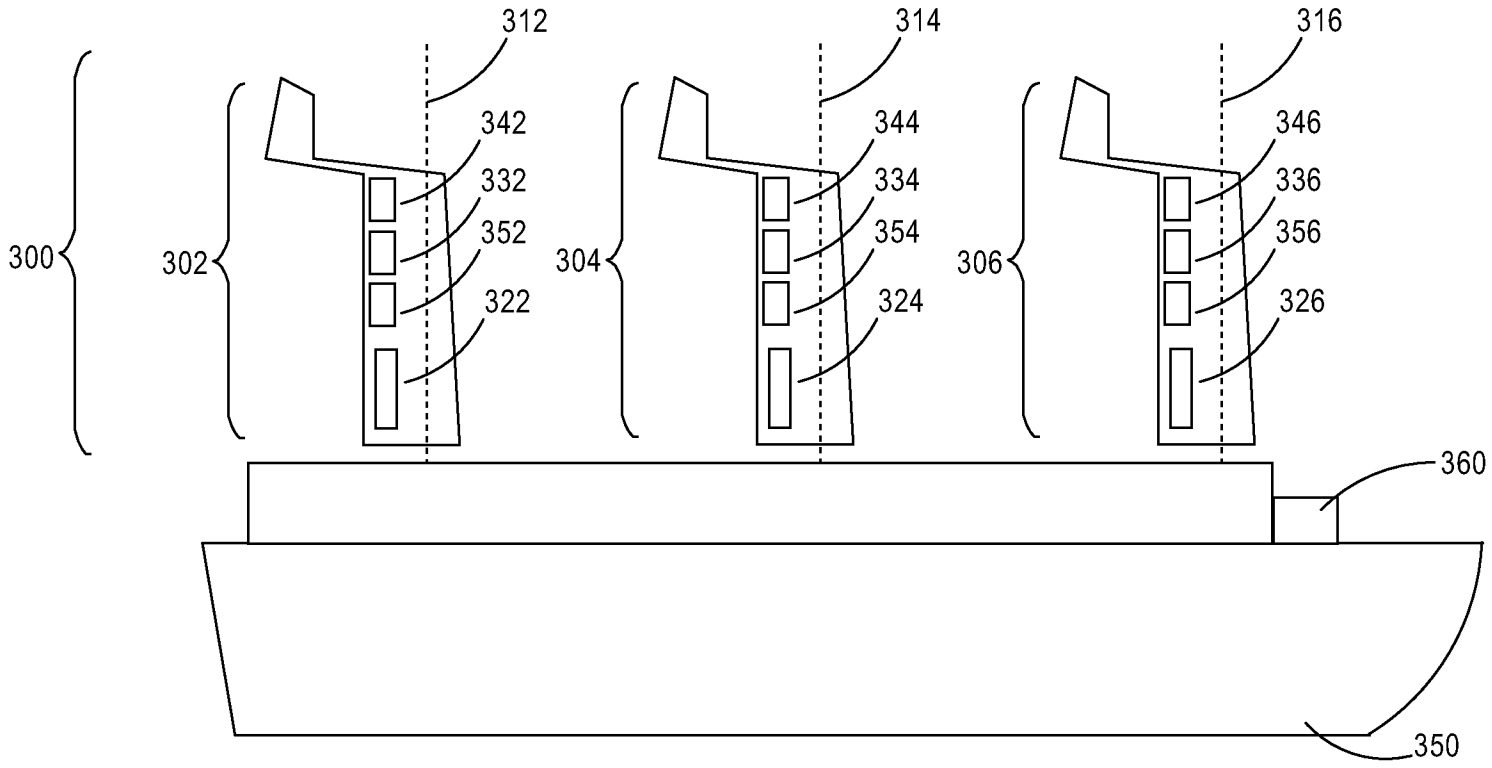
FIG. 3 illustrates a vessel outfitted with an embodiment of a wing sail device comprising multiple high-tailed wing sails.

FIG. 3 illustrates a vessel outfitted with an embodiment of a wing sail device comprising multiple high-tailed wing sails. Vessel 350 is outfitted with wing sail device 300. Wing sail device 300 is a system comprising two or more high-tailed wing sails 302-306, such as or similar to high-tailed wing sail 100. Wing sail device 300 is deployed on vessel 350 as a wind-based propulsion system. In one embodiment, wing sail device 300 is a secondary propulsion system of vessel 350. Each high-tailed wing sail 302-306 is configured to rotationally couple with vessel 350 and is configured to freely rotate with respect to vessel 350 about respective rotational axes 312-316. High-tailed wing sails 302-306 generate lift that is usable to propel vessel 350.

High-tailed wing sails 302-306 may include one or more positioning devices 342-346. Positioning devices 342-346 are mechanical devices that are configured to reposition one or more components of high-tailed wing sails 302-306. Positioning devices 342-346 may include one or more belts, levers, arms, gears, chains, drives, motors, cams, cranks, actuators, wheels, springs, bands, shafts, or other mechanical components suitable for mechanically changing the position of any component. For example, a positioning device may be used to change the position of the control surface element of a high-tailed wing sail, such as control surface element 110.

High-tailed wing sails 302-306 may include one or more sensors 332-336. Sensors 332-336 include one or more devices capable of collecting data, such as a GPS device, a compass, a wing angle sensor, an accelerometer, other instruments relating to navigation, other instruments relating to vessel operation and/or vessel state, environmental sensors such as temperature, moisture, chemical or any other environmental sensor, or any other device capable of collecting data. For example, a wing angle sensor may be used to determine a wing angle of the wing body of a high-tailed wing sail 302-306 about its rotational axis 312-316. This information may be used by a control system 360 of vessel 350 and/or a control system 352-356 of an individual high-tailed wing sail 302-306 to determine an appropriate position for the control surface element of a high-tailed wing sail, such as control surface element 110. In one embodiment, one or more sensors 332-336 are deployed on vessel 350. For example, a wing angle sensor may be deployed on a receiving point of vessel 350, where the receiving point is designed to rotationally couple with a high-tailed wing sail 302-306. Other information from sensors deployed on vessel 350 may be used by controllers 352-356 and/or controllers 360, such as GPS information, navigational information, environmental information, or other data collected by a sensor of vessel 350.

High-tailed wing sails 302-306 may include one or more power sources 322-326. Power sources 322-326 are configured to power one or more components of high-tailed wing sails 302-306, such as positioning devices 342-346 and/or sensors 332-336. In one embodiment, power sources 322-326 include one or more solar panels and/or batteries. The solar panels are configured to charge one or more onboard batteries of high-tailed wing sails 302-306, allowing for the powering of components of high-tailed wing sails 302-306 without a wired connection. In one embodiment, components of high-tailed wing sails 302-306 are powered by one or more inductive power sources.

Vessel 350 includes a control system 360 configured to send signals to wing sail device 300. Alternatively and/or in addition, high-tailed wing sails 302-306 may each include one or more individual controllers 352-356 that are disposed on a particular high-tailed wing sail 302-306 and control elements of the particular high-tailed wing sail 302-306. In one embodiment, control system 360 send signals to each high-tailed wing sail 302-306 and provides a central point of control for the multiple high-tailed wing sails 302-306 wing sail device 300. For example, control system 360 may send an "on" signal when wind-based propulsion is desired or an "off" signal when wind-based propulsion is not desired. In response to the signal, at least one controller, such as individual controllers 352-356 and/or control system 360, is configured to position the respective control surface elements of high-tailed wing sails 302-306 in an off position, such that high-tailed wing sails 302-306 freely rotate to a position that minimizes drag.

Control system 360 may include a central controller of wing sail device 300 that is integrated with or distinct from a standard control system of vessel 350. Alternatively and/or in addition, each high-tailed wing sail 302-306 has one or more individual controllers 352-356, and control system 360 send signals to the individual controllers. For example, individual controllers 352-356 may directly control positioning devices 342-346 based on signals received from control system 360. Alternatively, control system 360 may send signals that directly control one or more positioning devices 342-346 of high-tailed wing sails 302-306. In one embodiment, at least one controller, such as individual controllers 352-356 and/or control system 360 is communicatively coupled with a wing angle sensor of one or more particular high-tailed wing sails 302-306, and is configured to control the position of the control surface element of the one or more particular high-tailed wing sails 302-306 based on the wing angle received from the wing angle sensor.

One or more controllers described herein, such as a controller of control system 360 and/or individual controllers 352-356, are any combination of hardware and/or software devices capable of generating signals that control one or more electro-mechanical components described herein. In one embodiment, one or more controllers are implemented on a computing device, which may include one or more processors, microprocessors, microcontrollers, computer processing units, specialized hardware, FPGAs, or the like.

In one embodiment, vessel 350 is a vessel that does not substantially heel during normal operation. Vessels that do not substantially heel during normal operation include multi-hull vessels and large vessels, such as passenger ferries, car fairies, tankers, cargo ships, and other large vessels that do not substantially heel during normal operation. Normal operation may be considered based on several factors, such as a percentage of operating time (e.g. 95% of operation or another percentile) or a sea state threshold (e.g. a sea state defined by a World Meteorological Organization (WMO) Sea State Code or any other sea state definition). Because heeling may substantially alter the position of a tip vortex relative to a wing body, a non-heeling high-tailed wing sail may have a wing tail whose position is fixed relative to the wing body.

Autonomous Configuration

Figure 4:
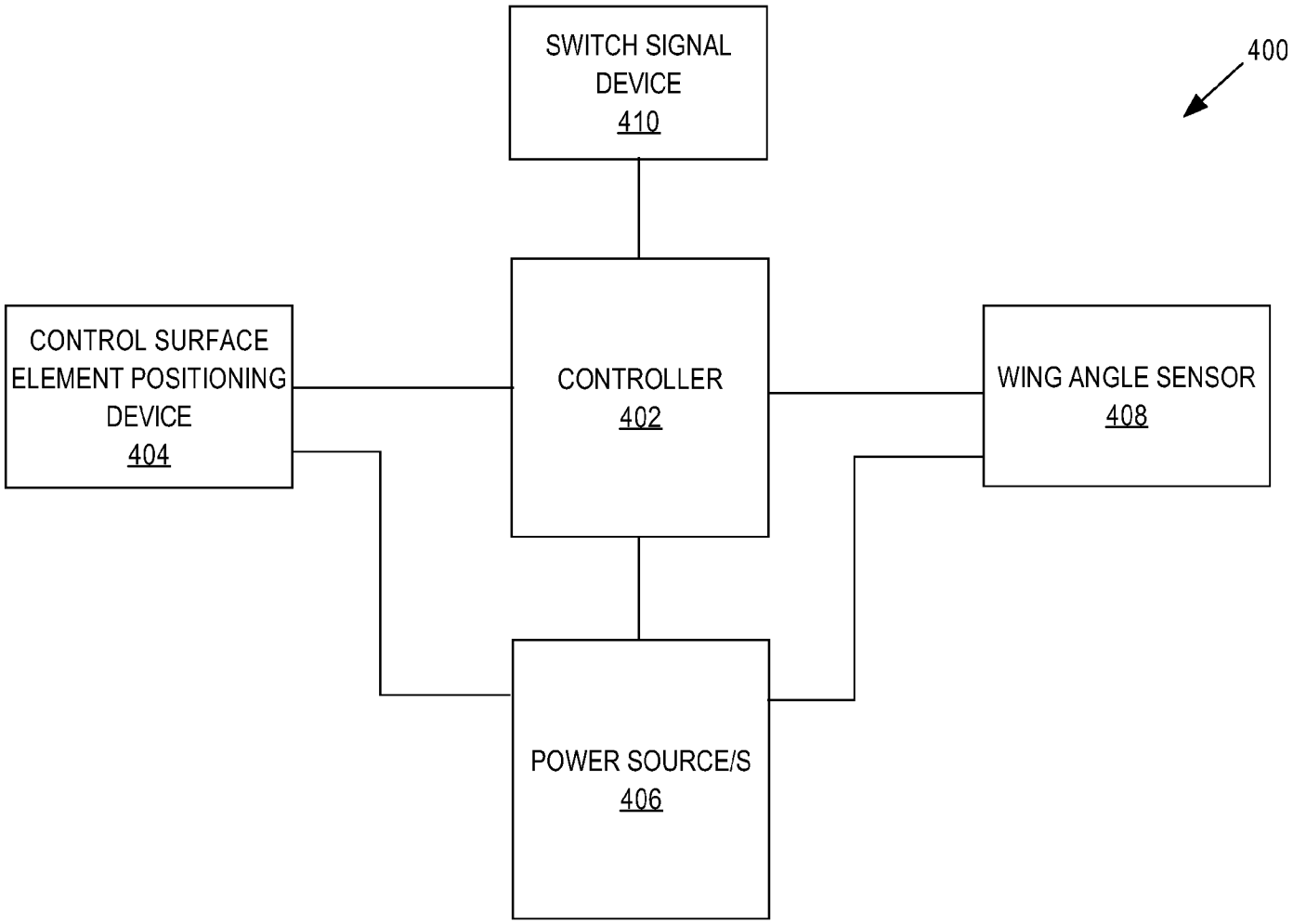
FIG. 4 illustrates a system diagram of an embodiment of a controller system for one or more high-tailed wing sails.

FIG. 4 illustrates a system diagram of an embodiment of a controller system for one or more high-tailed wing sails. In one embodiment, a wing sail device comprising a system of one or more high-tailed wing sails is deployed on a vessel to provide propulsion based on wind power when the system is activated. The vessel may have other propulsion systems, such as one or more fuel-powered propulsion systems. The wing system acts to reduce consumption of fuel. When the wing system is turned off, each of the one or more high-tailed wing sails is free to rotate into a low-drag position.

Control system 400 is a control system for a wing sail device comprising one or more high-tailed wing sails. Control system 400 includes controller 402. In response to the signal generated by switch signal device 410, controller controls the position of a control surface element of a high-tailed wing sail by sending a signal to control surface element positioning device 404. In one embodiment, a controller 402 is provided for each high-tailed wing sail in a wing sail device. Alternatively, a controller 402 may be configured to control multiple control surface element positioning devices 404 for two or more high-tailed wing sails.

Control surface element positioning device 404 comprises one or more mechanical devices that are configured to reposition the controls surface element based on one or more signals from controller 402. Control surface element positioning device 404 may include one or more belts, levers, arms, gears, chains, drives, motors, cams, cranks, actuators, wheels, springs, bands, shafts, or other mechanical components suitable for mechanically repositioning a control surface element of a high-tailed wing sail, such as control surface element 110.

Control system 400 includes switch signal device 410. Switch signal device 410 is configured to generate a signal to turn the system of one or more high-tailed wing sails on or off. For example, control system 360 may send an "on" signal when wind-based propulsion is desired or an "off" signal when wind-based propulsion is not desired. In one embodiment, such signal device 410 is integrated into one or more control systems of a vessel outfitted with the one or more high-tailed wing sails. In one embodiment, one switch signal device 410 controls multiple high-tailed wing sails such that they may be powered on and off in synchrony. In one embodiment, in response to an "off" signal from switch signal device 410, controller 402 causes control surface element positioning device 404 to reposition control surface element 110 in an off position such that the corresponding high-tailed wing sail freely rotates to a position that essentially minimizes drag and where essentially no lift is generated.

Control system 400 includes wing angle sensor 408. Wing angle sensor 408 determines a wing angle of the wing body of a high-tailed wing sail about its rotational axis. Wing angle sensor 408 is communicatively coupled with controller 402. Controller 402 is configured to control the position of the control surface element via control surface element positioning device 404 based on the wing angle received from the wing angle sensor unless the wing sail device is inactive, such as when the wing sail device is turned off using switch signal device 410. Wing angle sensor 408 may be communicatively coupled with controller 402, such as via a wire, a circuit or another electronic component. Wing angle sensor 408 may also communicate wirelessly with controller 402.

Control system 400 further includes at least one power source 406. Power source 406 may include one or more power sources, such as battery and/or a solar panel. In one embodiment, power source 406 powers controller 402 and/or control surface element positioning device 404. In one embodiment, power source 406 includes at least one solar panel configured to charge at least one rechargeable battery that powers controller 402 and control surface element positioning device 404. Alternatively, at least one of controller 402 and control surface element positioning device 404 may be powered by another power source.

Positionable Tail

When a vessel heels during normal operation, the location of the tip vortex relative to the wing tip may change. In this case, the optimal position of the wing tail relative to the wing tip may change during normal operation based on a heeling angle of the vessel. Typically, the heeling angle of the vessel is defined relative to an axis running down the length of the vessel from the bow to the stern.

Figure 5:
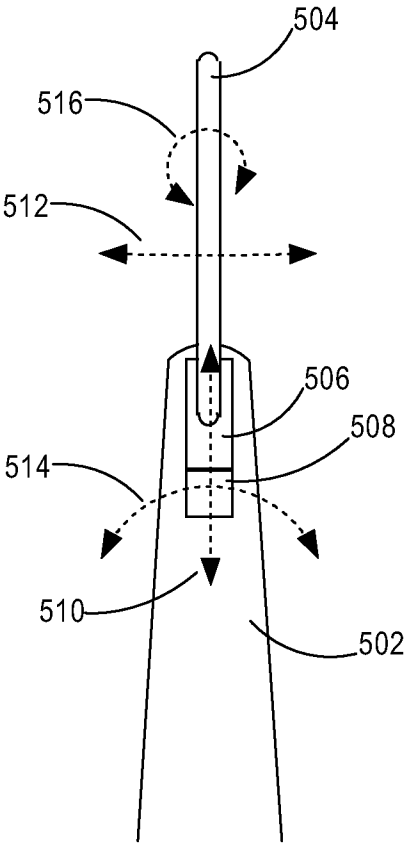
FIG. 5 illustrates a system diagram of an embodiment of a controller system for positioning a wing tail.

FIG. 5 illustrates an embodiment of a positioning device for a movably coupled wing tail. Wing tail 504 is movably coupled to wing body 502. In one embodiment, wing tail 504 is movably coupled to wing body 502 with a positioning device comprising positioning device elements 506-508. The positioning device is configured to reposition the wing tail in a plurality of positions with respect to wing body 502. The positioning device may be in addition to any control surface element, such as control surface element 110, that is configured to aerodynamically position wing tail 504 based on an aerodynamic force. Wing tail positioning device elements 506-508 may include one or more belts, levers, arms, gears, chains, drives, motors, cams, cranks, actuators, wheels, springs, bands, shafts, or other mechanical components suitable for mechanically repositioning wing tail 504 in a plurality of positions with respect to wing body 502.

Positioning device elements 506-508 may be configured to reposition wing tail 504 in various paths, angles, and/or dimensions. In one embodiment, wing tail 504 may be repositioned at varying distances along vertical positioning path 510 to move wing tail 504 higher or lower with respect to wing body 502. In one embodiment, wing tail 504 may be repositioned at varying positions along a horizontal positioning path 512 to move wing tail 504 left or right with respect to wing body 502. In one embodiment, wing tail 504 may be repositioned at varying positions along an arc positioning path 514. In one embodiment, wing tail 504 may be repositioned at different angles 516 with respect to wing body 502. In one embodiment, wing tail 504 may be repositioned at varying distances toward or away from wing body 502. Any combination of these movements may be used to reposition wing tail 504.

Figure 6:
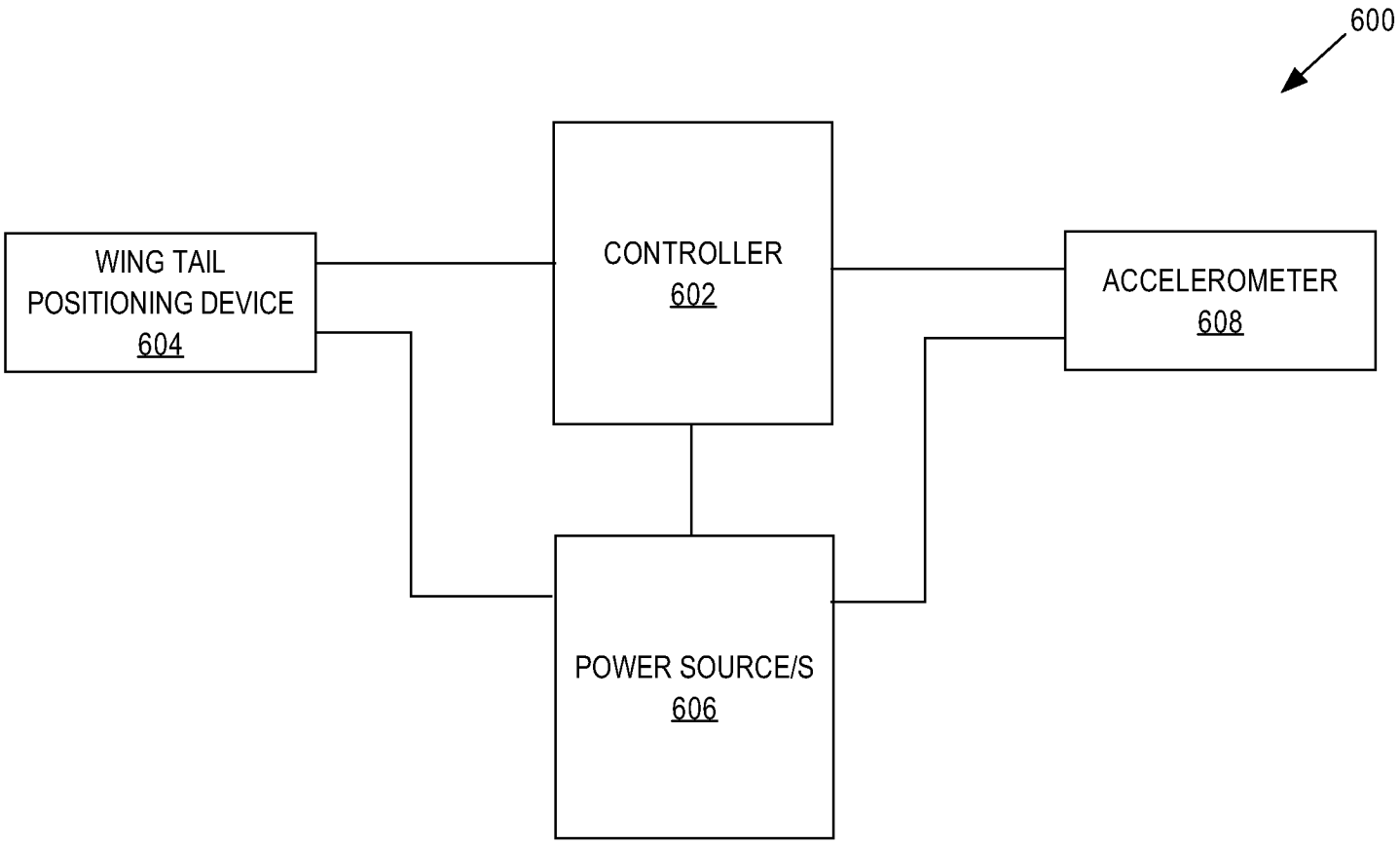
FIG. 6 illustrates an embodiment of a positioning device for a movably coupled wing tail.

FIG. 6 illustrates a system diagram of an embodiment of a controller system for positioning a wing tail. In one embodiment, a wing sail device comprising a system of one or more high-tailed wing sails is deployed on a vessel to provide propulsion based on wind power. Control system 600 is a control system for a wing sail device comprising one or more high-tailed wing sails. Control system 600 includes controller 602. Controller 602 is configured to instruct wing tail positioning device to reposition the wing tail based on a heeling angle.

Wing tail positioning device 604 is configured to move a wing tail 504 to a plurality of positions with respect to a wing body 502 of a high-tailed wing sail device. Wing tail positioning device 604 comprises one or more mechanical devices that are configured to reposition the wing tail based on one or more signals from controller 402.

Control system 600 includes accelerometer 608. Accelerometer 608 is configured to determine a value usable to determine a heeling angle of wing body 502. Accelerometer 608 is communicatively coupled with controller 602. Controller 602 is configured to control the position of the wing tail 504 via wing tail positioning device 604 based on the heeling angle. In one embodiment, controller 602 determines the heeling angle based on the value determined by accelerometer 608. Alternatively, accelerometer 608 may directly determine and transmit a value that is the heeling angle. Accelerometer 608 may be communicatively coupled with controller 602, such as via a wire, a circuit or another electronic component. Accelerometer 608 may also communicate wirelessly with controller 602.

Control system 600 further includes at least one power source 606. Power source 606 may include one or more power sources, such as battery and/or a solar panel. In one embodiment, power source 606 powers controller 602 and/or control surface element positioning device 404. In one embodiment, power source 406 includes at least one solar panel configured to charge at least one rechargeable battery that powers controller 602 and wing tail positioning device 604. Alternatively, at least one of controller 602 and wing tail positioning device 604 may be powered by another power source.

In one embodiment a wing sail device includes both a control system for positioning a control surface element, such as control system 400, and a control system for positioning a wing tail, such as control system 600. In one embodiment, a controller for positioning a wing tail and the controller for positioning the control surface element may be integrated into the same controller device.

Control System Hardware

Figure 7:
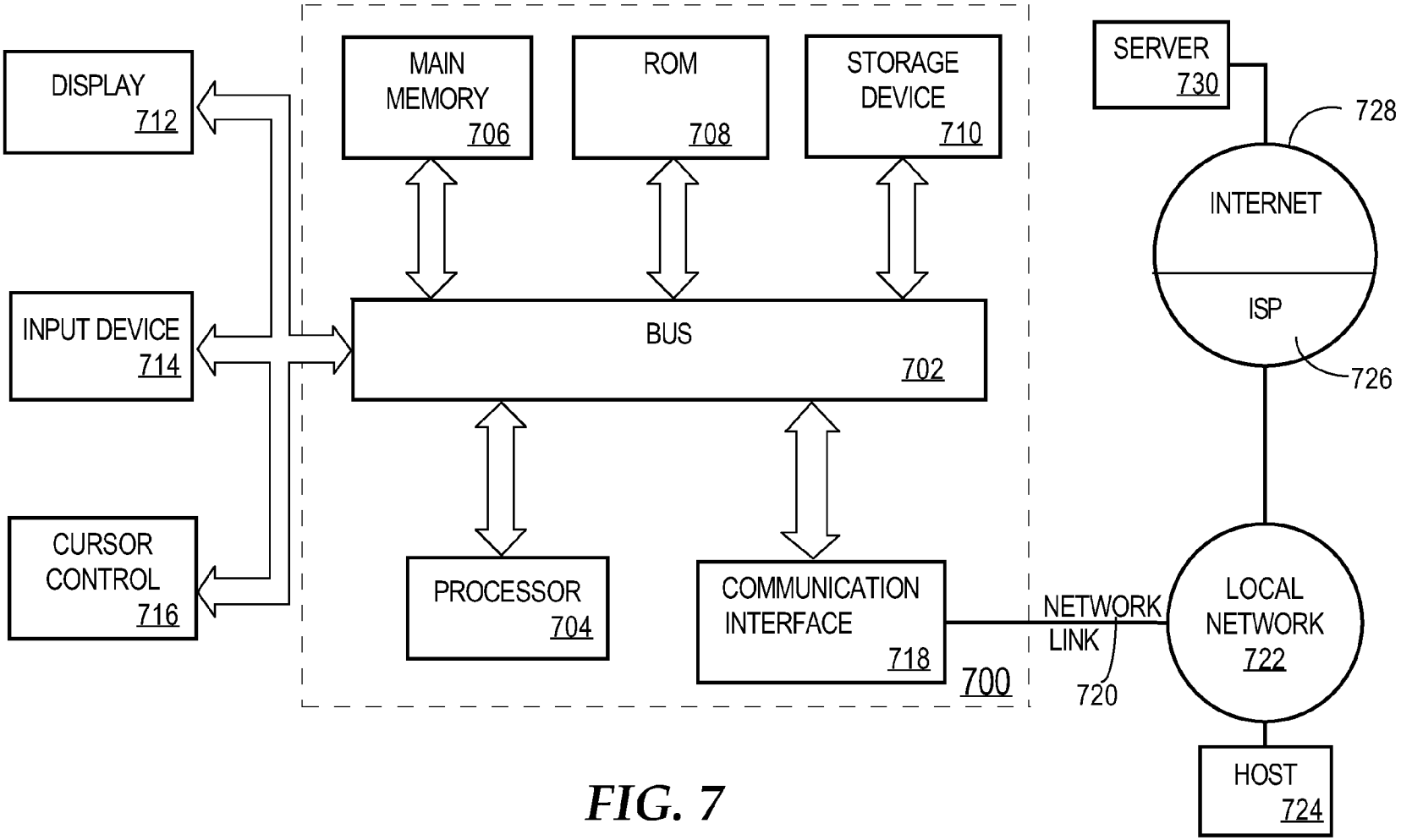
FIG. 7 is a block diagram that illustrates an embodiment of a computing device on which one or more control systems may be implemented.

One or more control systems described herein may be implemented at least in part on one or more computing devices, such as in hardware and/or in hardware. FIG. 7 is a block diagram that illustrates an embodiment of a computer system on which one or more control systems may be implemented.

FIG. 7 is a block diagram that illustrates a computing device 700 upon which an embodiment of the invention may be implemented. Computing device 700 includes a bus 702 or other communication mechanism for communicating information, and a processor 704 coupled with bus 702 for processing information. Computing device 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Computing device 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computing device 700 may be coupled via bus 702 to a display 712, such as a cathode ray tube (CRT), for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

The invention is related to the use of computing device 700 for implementing the techniques described herein. According to one embodiment of the invention, those techniques are performed by computing device 700 in response to processor 704 executing one or more sequences of one or more instructions contained in main memory 706. Such instructions may be read into main memory 706 from another machine-readable medium, such as storage device 710. Execution of the sequences of instructions contained in main memory 706 causes processor 704 to perform the process steps described herein. In alternative embodiments, hard-wired circuitry may be used in place of or in combination with software instructions to implement the invention. Thus, embodiments of the invention are not limited to any specific combination of hardware circuitry and software.

The term "machine-readable medium" as used herein refers to any medium that participates in providing data that causes a machine to operation in a specific fashion. In an embodiment implemented using computing device 700, various machine-readable media are involved, for example, in providing instructions to processor 704 for execution. Such a medium may take many forms, including but not limited to storage media and transmission media. Storage media includes both non-volatile media and volatile media. Non-volatile media includes, for example, optical or magnetic disks, such as storage device 710. Volatile media includes dynamic memory, such as main memory 706. Transmission media includes coaxial cables, copper wire and fiber optics, including the wires that comprise bus 702. Transmission media can also take the form of acoustic or light waves, such as those generated during radio-wave and infra-red data communications. All such media must be tangible to enable the instructions carried by the media to be detected by a physical mechanism that reads the instructions into a machine.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 704 for execution. For example, the instructions may initially be carried on a magnetic disk of a remote computer. The remote computer can load the instructions into its dynamic memory and send the instructions over a telephone line using a modem. A modem local to computing device 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computing device 700 also includes a communication interface 718 coupled to bus 702. Communication interface 718 provides a two-way data communication coupling to a network link 720 that is connected to a local network 722. For example, communication interface 718 may be an integrated services digital network (ISDN) card or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computing device 700, are exemplary forms of carrier waves transporting the information.

Computing device 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution. In this manner, computing device 700 may obtain application code in the form of a carrier wave.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A wing sail device comprising:

a wing body comprising a wing tip and a wing base configured to rotationally couple with a vessel, wherein the wing body is configured to freely rotate with respect to the vessel about a rotational axis; and a wing tail rigidly coupled to the wing body such that a top end of the wing tail is higher than the wing tip of the wing body;

wherein, when an air flow interacts with the wing sail device, the rigidly coupled wing tail generates a stabilizing force on the wing body that keeps the wing body at a desired angle about the rotational axis relative to the wind.

2. The wing sail device of claim 1, wherein the wing tail is rigidly coupled to the wing body by a substantially rigid coupling arm that transfers the stabilizing force from the wing tail to the wing body.

3. The wing sail device of claim 1, further comprising a control surface element configured to aerodynamically control rotation of the wing body with respect to the rotational axis based on a force exerted by an air flow interacting with the control surface element.

4. The wing sail device of claim 3, further comprising:

a wing angle sensor configured to determine a wing angle of the wing body about the rotational axis; and at least one controller communicatively coupled with the wing angle sensor, wherein the at least one controller is configured to control a position of the control surface element based on the wing angle.

5. The wing sail device of claim 4, wherein the at least one controller is further configured to position the control surface element in an off position in response to an "off" signal.

6. The wing sail device of claim 4, further comprising:

a second wing body comprising a second wing tip and a second wing base configured to rotationally couple with the vessel, wherein the second wing body is configured to freely rotate with respect to the vessel about a second rotational axis;

a second wing tail coupled to the second wing body such that a top end of the second wing tail is higher than the second wing tip of the second wing body; and a second wing angle sensor configured to determine a second wing angle of the second wing body with respect to the second rotational axis, a second control surface element configured to aerodynamically control a second wing angle of the second wing body about the second rotational axis based on a force exerted by an air flow interacting with the second control surface element;

wherein the at least one controller is communicatively coupled with the second wing angle sensor, wherein the at least one controller is configured to control a position of the second control surface element based on the second wing angle.

7. The wing sail device of claim 6, wherein the at least one controller is further configured to position the control surface element and the second control surface element in an off position in response to an "off" signal.

8. The wing sail device of claim 1, wherein a mass of the wing sail device is dynamically balanced with respect to the rotational axis.

9. The wing sail device of claim 1, wherein the wing sail device is statically balanced with respect to the rotational axis.

10. The wing sail device of claim 1, wherein the wing tail is movably coupled to the wing body, the wing sail device further comprising:

a positioning device configured to move the wing tail to a plurality of positions with respect to the wing body;

an accelerometer configured to determine a value usable to determine a heeling angle of the wing body; and a controller communicatively coupled with the accelerometer and the positioning device, wherein the controller is configured to instruct the positioning device to reposition the wing tail based on the heeling angle.

11. A wing sail device comprising:

a wing body comprising a wing base configured to rotationally couple with a vessel and a wing tip, wherein the wing sail is configured to freely rotate with respect to the vessel about a rotational axis;

a wing tail coupled to the wing body in a position such that, when an air flow interacts with the wing sail device, a tip vortex generated by a pressure differential on the wing body exerts an additional force on the wing tail;

a control surface element configured to aerodynamically control rotation of the wing body with respect to the rotational axis based on a force exerted by an air flow interacting with the control surface element;

a wing angle sensor configured to determine a wing angle of the wing body about the rotational axis; and at least one controller communicatively coupled with the wing angle sensor, wherein the at least one controller is configured to control a position of the control surface element based on the wing angle.

12. The wing sail device of claim 11, wherein the wing tail is positioned in an upper half of the tip vortex.

13. The wing sail device of claim 11, wherein the at least one controller is further configured to position the control surface element in an off position in response to an "off" signal.

14. The wing sail device of claim 11, further comprising:

a second wing body comprising a second wing base configured to rotationally couple with the vessel and a second wing tip, wherein the second wing body freely rotates about a second rotational axis;

a second wing tail coupled to the second wing body, wherein at least a portion of the second wing tail is positioned in a second tip vortex generated at the second wing tip by a pressure differential on the second wing body; and a second wing angle sensor configured to determine a second wing angle of the second wing body about the second rotational axis, a second control surface element configured to aerodynamically control a second wing angle of the second wing body with respect to the second rotational axis based on a force exerted by an air flow interacting with the second control surface element;

wherein the at least one controller is communicatively coupled with the second wing angle sensor, wherein the at least one controller is configured to control a position of the second control surface element based on the second wing angle.

15. The wing sail device of claim 14, wherein the at least one controller is further configured to position the control surface element and the second control surface element in an off position in response to an "off" signal.

16. The wing sail device of claim 11, wherein a mass of the wing sail device is dynamically balanced with respect to said the rotational axis.

17. The wing sail device of claim 11, wherein the wing sail device is statically balanced with respect to the rotational axis.

18. A wing sail device comprising:

a wing body comprising a wing base configured to rotationally couple with a vessel and a wing tip, wherein the wing sail is configured to freely rotate with respect to the vessel about a rotational axis;

a wing tail coupled to the wing body in a position such that, when an air flow interacts with the wing sail device, a tip vortex generated by a pressure differential on the wing body exerts an additional force on the wing tail;

wherein the wing tail is movably coupled to the wing body;

a positioning device configured to move the wing tail to a plurality of positions with respect to the wing body;

an accelerometer configured to determine a value usable to determine a heeling angle of the wing body; and a controller communicatively coupled with the accelerometer and the positioning device, wherein the controller is configured to instruct the positioning device to reposition the wing tail based on the heeling angle.

19. The wing sail device of claim 18, wherein the wing tail is positioned in an upper half of the tip vortex.

20. The wing sail device of claim 18, wherein a mass of the wing sail device is dynamically balanced with respect to said the rotational axis.

* * * * *